US010415141B2

(12) United States Patent
O'Sullivan et al.

(10) Patent No.: US 10,415,141 B2
(45) Date of Patent: Sep. 17, 2019

(54) PROCESS FOR PRODUCING A LAYER

(71) Applicant: PLANSEE SE, Reutte (AT)

(72) Inventors: Michael O'Sullivan, Ehenbichl (AT); Martin Kathrein, Reutte (AT); Gerhard Leichtfried, Reutte (AT); Thomas Hosp, Berwang (AT); Bernhard Lang, Haeselgehr (AT); Dietmar Sprenger, Waengle (AT)

(73) Assignee: Plansee SE, Reutte (AT)

( * ) Notice: Subject to any disclaimer, the term of this patent is extended or adjusted under 35 U.S.C. 154(b) by 146 days.

(21) Appl. No.: 15/323,351

(22) PCT Filed: Jun. 30, 2015

(86) PCT No.: PCT/AT2015/000092
§ 371 (c)(1),
(2) Date: Dec. 30, 2016

(87) PCT Pub. No.: WO2016/000004
PCT Pub. Date: Jan. 7, 2016

(65) Prior Publication Data

US 2017/0183780 A1 Jun. 29, 2017

(30) Foreign Application Priority Data

Jul. 3, 2014 (AT) ..... GM273/2014 U

(51) Int. Cl.
*C23C 24/04* (2006.01)
*B05B 7/00* (2006.01)
(Continued)

(52) U.S. Cl.
CPC ..... *C23C 24/04* (2013.01); *B05B 7/0025* (2013.01); *B05B 7/0075* (2013.01); *B05B 7/14* (2013.01);
(Continued)

(58) Field of Classification Search
CPC ..... B05B 7/0025; B05B 7/0075; B05B 7/14; B05B 7/16; B05B 7/1626; B05B 7/228; C23C 24/04; H05H 2001/3484
(Continued)

(56) References Cited

U.S. PATENT DOCUMENTS 5,302,414 A 4/1994 Alkhimov et al.
7,910,051 B2 3/2011 Zimmermann et al.
(Continued)

FOREIGN PATENT DOCUMENTS

CN 102260869 A 11/2011
CN 102286740 A 12/2011
(Continued)

OTHER PUBLICATIONS

Kang, Hyun-Ki et al. "Tungsten-copper composite deposits produced by a cold spray". Scripta Materialia 49 (2003) 1169-1174. (Year: 2003).*
(Continued)

*Primary Examiner* — Alexander M Weddle
(74) *Attorney, Agent, or Firm* — Laurence A. Greenberg; Werner H. Stemer; Ralph E. Locher

(57) ABSTRACT

A process for producing a layer or a body built up of layers. A process gas which has a pressure of >10 bar is accelerated in a convergent-divergent nozzle and a coating material which is formed by particles and is composed of Mo, W, an Mo-based alloy or a W-based alloy is injected into the process gas. The particles are at least partly present as aggregates and/or agglomerates. It is possible to produce dense layers and components in this way. We also describe layers and components having a microstructure with cold-deformed grains having a high aspect ratio.

15 Claims, 1 Drawing Sheet

(51) Int. Cl.

| | |
|---|---|
| ***B05B 7/14*** | (2006.01) |
| ***B05B 7/16*** | (2006.01) |
| ***B05B 7/22*** | (2006.01) |
| *H05H 1/34* | (2006.01) |

(52) U.S. Cl.
CPC ..... *B05B 7/16* (2013.01); *B05B 7/1626* (2013.01); *B05B 7/228* (2013.01); *H05H 2001/3484* (2013.01)

(58) Field of Classification Search
USPC ..... 427/180
See application file for complete search history.

(56) References Cited

U.S. PATENT DOCUMENTS

| | | | | |
|---|---|---|---|---|
| 8,197,894 | B2 * | 6/2012 | Miller | B22F 1/0014 427/192 |
| 9,334,565 | B2 | 5/2016 | Rozak et al. | |
| 9,527,069 | B2 | 12/2016 | Heinrich et al. | |
| 2006/0090593 | A1 * | 5/2006 | Liu | B22F 1/0048 75/252 |
| 2008/0093350 | A1 * | 4/2008 | Ma | B23K 35/0227 219/145.1 |
| 2008/0216602 | A1 | 9/2008 | Zimmermann et al. | |
| 2008/0271779 | A1 | 11/2008 | Miller et al. | |
| 2014/0336046 | A1 | 11/2014 | Heinrich et al. | |

FOREIGN PATENT DOCUMENTS

| | | | |
|---|---|---|---|
| CN | 102615288 | A | 8/2012 |
| CN | 102363852 | B | 4/2013 |
| DE | 102005004117 | A1 | 4/2006 |
| EP | 0484533 | A1 | 5/1992 |
| EP | 0924315 | A1 | 6/1999 |
| EP | 2009132 | A1 | 12/2008 |
| EP | 2620525 | A1 | 7/2013 |
| JP | S58113369 | A | 7/1983 |
| JP | 2008540823 | A | 11/2008 |
| JP | 2010526211 | A | 7/2010 |
| JP | 2012031443 | A | 2/2012 |
| JP | 2015512765 | A | 4/2015 |
| KR | 1020080065480 | A | 7/2008 |
| WO | 2006117145 | | 11/2006 |
| WO | 2012008413 | A1 | 1/2012 |
| WO | 2013058376 | A1 | 4/2013 |
| WO | 2013110441 | A1 | 8/2013 |
| WO | 2013169342 | A1 | 11/2013 |
| WO | 2014073633 | A1 | 5/2014 |

OTHER PUBLICATIONS

Kang H-K., et al. : Thungsten/copper composite deposits produced by a cold spray, Scripta Materialia, Elsevier, Amsterdam, NL. vol. 49, No. 12, Dec. 1, 2003.
Ramin Ghelichi, et al.: "Coating by the Cold Spray Process: a state of the art", DOI: 10.3221/IGF-ESIS.08, Jan. 1, 2009, 20156 Milan, Italy.

* cited by examiner

PROCESS FOR PRODUCING A LAYER

BACKGROUND OF THE INVENTION

Field of the Invention

The invention relates to a process for producing a layer or a body built up of layers, where a coating material which is formed by particles and is composed of molybdenum (Mo), tungsten (W), an Mo-based alloy or a W-based alloy and also a process gas which has a pressure of >10 bar are provided, the process gas is accelerated in a convergent-divergent nozzle and the coating material is injected into the process gas before, in or after the convergent-divergent nozzle. The invention further relates to a layer having an average layer thickness of >10 μm or a body made up of layers which contains at least 80 at. % of Mo and/or W.

Coating processes in which powder particles are applied with very high kinetic energy and low thermal energy to a support material are subsumed under the term cold gas spraying (CGS). The cold gas spraying technology is described, for example in EP 484 533 A1. A process gas (for example air, He, $N_2$ or mixtures thereof) under high pressure is depressurized by means of a convergent-divergent nozzle (also referred to as supersonic nozzle). A typical nozzle shape is the Laval nozzle (or else referred to as de Laval nozzle). Depending on the process gas used, gas velocities of, for example, from 900 m/s (in the case of $N_2$) to 2500 m/s (in the case of He) can be achieved. The coating material is, for example, injected into the gas stream before the narrowest cross section of the convergent-divergent nozzle which forms part of the spray gun, typically accelerated to a velocity of from 300 to 1200 m/s and deposited on the substrate.

Heating of the gas before the convergent-divergent nozzle increases the flow velocity of the gas and thus also the particle velocity in the expansion of the gas in the nozzle. EP 924 315 A1 describes a process in which the gas is heated in a heater immediately after leaving the gas buffer and the heated gas is fed to the spray gun. DE 102005004117 A1 describes a CGS process in which the gas is heated after the gas buffer and at the spray gun. A gas temperature in the range from room temperature to 600° C. is typically employed in cold gas spraying in order to utilize the main advantage of CGS, namely the low reaction with gases.

CGS allows, in particular, ductile materials having a cubic face centered and hexagonal closest packed lattice to be sprayed to form dense layers having good adhesion. The layer structure is built up in layers from the individual particles of the coating material. The adhesion of the coating material to the substrate material and the cohesion between the particles of the coating material are critical to the quality of a CGS layer. The adhesion both in the region of the coating material of the substrate interface and also between the particles of the coating material is in principle an interplay between a number of physical and chemical adhesion mechanisms and is partly still not comprehensively understood.

The following mechanisms have been discussed in the literature. In one model, the adhesion is explained by mechanical intermeshing effects caused by interface instabilities due to different viscosities and resulting interface corrugations and turbulences. A further model assumes that conditions for a high interfacial strength are created only by impingement of further particles on a particle which is already adhering. A third model assumes that the particles which impinge first on the substrate adhere to the surface by van der Waals forces and strong adhesion can be achieved only as a result of further particles which impinge on the previously deposited particles. A further theory attributes adhesion to topochemical reactions. Adhesion is also explained by adiabatic shear instabilities occurring at the interface. For this purpose, it is necessary for the particles to exceed a critical velocity on impingement. When adiabatic shear instabilities occur, deformation and the resulting heating is concentrated only in small regions while surrounding regions are not heated and are also significantly less deformed. An influence of the lattice orientation or the relationship between the lattice orientations of two adjacent grains has also been discussed.

Important demands made of a layer, for example layer adhesion, low porosity, high grain boundary strength and layer ductility, are satisfied to differing degrees by various coating materials. There is a unanimous opinion prevailing in the literature that the brittle, cubic body centered materials molybdenum and tungsten have a particularly unfavorable property profile for them to be deposited by a cold gas spraying process to give dense layers which adhere well.

On the subject, CN 102615288 A describes the production of a free-flowing molybdenum coating material by means of the steps of milling of Mo powder with addition of deionized water, polyethylene glycol and polyvinyl alcohol, followed by centrifugal spray granulation, sintering at high temperatures and subsequent comminution of the sintered particles. CN 102615288 A states that an approximately spherical, dense and free-flowing molybdenum powder is obtained. Although blockages in conveying systems are avoided by means of a powder according to this patent application, thick and dense layers which do not adhere well are deposited.

CN 102363852 A describes a W—Cu layer which has been deposited by CGS using a gas pressure of from 2.5 to 3 MPa and a gas temperature of from 400 to 600° C. Good strength of adhesion between particles and substrate and cohesion between the particles is achieved by means of a coating of copper on the tungsten particles.

CN 102286740 A also describes a process for producing an Mo—Cu or W—Cu CGS layer having a high Cu content, where the process gas temperature is from 100 to 600° C.

CN 102260869 A in turn discloses a W layer deposited on a Cu or steel substrate. When using helium as process gas, the gas preheating temperature was from 200 to 500° C., in the case of $N_2$ from 500 to 800° C. Although very high gas pressures of from 20 to 50 bar and comparatively soft substrate materials such as copper and austenitic steel, in which favorable intermeshing behavior between coating material and substrate occurs, were employed, an average layer thickness of only <10 μm was achieved. An average layer thickness of <10 μm is a clear indication that only one layer was able to be built up. The formation of the first layer depends only on the interaction between coating material and substrate. Favorable substrate properties can thus compensate for unfavorable properties of the coating material.

A cold-gas-sprayed Mo or W layer in a listing with Nb, Ta, Cr, Ti, Zr, Ni, Co, Fe, Al, Ag, Cu or alloys thereof having an O content of <500 ppm and an H content of <500 ppm is disclosed in WO 2008/057710 A2. A gas temperature of 600° C. is disclosed for the examples using Ta, Nb and Ni. Ta, Nb and Ni are very soft and ductile materials which can readily be deposited by means of CGS to form layers. The examples do not present any experimental results for the materials Mo, Cr, Ti, Zr, Ni, Co, Fe, Al, Ag and Cu.

BRIEF SUMMARY OF THE INVENTION

It is therefore an object of the present invention to provide a process by means of which CGS layers of Mo, W, an Mo-based alloy or a W-based alloy can be produced inexpensively in a reliable process. Inexpensively can, for example, imply that the use of He as process gas can be dispensed with, since He is a large cost factor in cold gas spraying. Furthermore, it is an object of the present invention to provide a process which leads to layers which display good layer adhesion, a high density, low residual stresses, a satisfactory layer thickness and a low defect density, for example micro cracks between the individual layers. In addition, it is an object of the invention to provide a CGS layer having the abovementioned properties.

A further object of the invention is to provide a process by means of which a body which is composed of Mo, W, an Mo-based alloy or a W-based alloy and is made up of many layers and has a high density, low residual stresses and a low defect density, for example micro cracks between the individual layers, can be produced inexpensively in a reliable process.

The object is achieved by the independent claims. Particular embodiments are indicated in the dependent claims.

The process serves to deposit a layer on a substrate body. The layer can be made up of one layer or of a plurality of sub layers. However, a body which is made up of many layers and is preferably self-supporting can also be produced by means of the process. For this purpose, many layers are deposited on a substrate. When the substrate is removed after deposition of the layer, the substrate is referred to as lost mold.

A coating material composed of Mo, W, an Mo-based alloy or a W-based alloy is employed for depositing the layer or for producing the body. For the purposes of the invention, an Mo-based alloy is an alloy containing at least 50 at. % of Mo. A W-based alloy contains at least 50 at. % of W. A preferred Mo or W content is >80 at. %. Particularly advantageous Mo or W contents are >90 at. %, >95 at. % or 99 at. %. Furthermore, the process is suitable for producing a layer or a body composed of an Mo—W or W—Mo alloy. These alloys are alloys whose total content of Mo and W is >80 at. %, preferably >90 at. %, particularly preferably >95 and >99 at. %.

The coating material is injected into a process gas having a pressure of at least 10 bar, preferably at least 20 bar and particularly preferably at least 30 bar, before a convergent-divergent nozzle, into a convergent-divergent nozzle or after a convergent-divergent nozzle. The process gas preferably has a pressure of from 10 to 100 bar, particularly advantageously from 20 to 80 bar or from 30 to 60 bar. The upper limit to the pressure range is partly determined by the plants available at pressure. Should plants which allow a higher process gas pressure become available in the future, the limit is moved to higher pressures.

The coating material is made up of particles. A plurality of particles is referred to as powder. A plurality of powder particles can be converted into powder granules by granulation. The size of the powder particles or powder granule particles is referred to as particle size and is usually measured by means of laser light scattering. The measurement results are reported as distribution curve. The $d_{50}$ value here indicates the average particle size. $d_{50}$ means that 50% of the particles are smaller than the indicated value.

According to the invention, the particles are present at least partly as aggregates and/or agglomerates; this means that the particles can be present at least partly as aggregate, as agglomerates or as a mixture of aggregates and agglomerates. Here, an aggregate is, in powder metallurgy, a cluster of primary particles which are joined via a strong bond, while an agglomerate is a cluster of primary particles bound to one another by a weak bond (see, for example, German, R.: "Introduction to Powder Metallurgy Science", MPIF, Princeton (1984), 32). If the primary particles have very different sizes, the smaller particles are frequently also referred to as secondary particles. In the following, the term aggregate will be used to refer to a cluster which cannot be broken up by conventional ultrasonic deagglomeration, while agglomerates can be at least partially broken up into the primary particles or primary and secondary particles. Ultrasonic deagglomeration is here carried out at 20 kHz and 600 W. The coating material is advantageously present as aggregate. The bonding between the primary particles or primary and secondary particles of which an aggregate is made up is adhesive (metallurgical bonding), preferably without the involvement of other elements. It is particularly advantageous for >10% by mass or >20% by mass, in particular >50%, of all particles to be present as aggregate or agglomerate. The evaluation is carried out as follows: five samples are taken and are examined by means of a scanning electron microscope. At an enlargement which encompasses from 20 to 50 particles in the image section, the sum of the particles which are present as aggregate or agglomerate can be determined in a simple way. The number of the particles present as aggregate or agglomerate is then divided by the total number of particles evaluated and the average of five samples is determined.

It has now been found that the inventive effect can also be achieved when the particles of the coating material at least partly have an average porosity determined by means of quantitative image analysis of >10% by volume. Porosity and powder form thus have a comparable influence on the deposition behavior of the powder particles, as will be discussed in detail below.

It is particularly advantageous for >10%, preferably >20%, in particular >50%, of all particles to have a porosity of >10% by volume. The evaluation is carried out by means a scanning electron microscopic examination analogous to the above-described determination of the number of particles present as aggregate or agglomerate. Preferred ranges for the porosity P are 10% by volume<P<80% by volume or 20% by volume<P<70% by volume.

The determination of the average porosity is carried out according to the following method. Powder polished sections are firstly produced. The powder is for this purpose embedded in epoxy resin. After a curing time of 8 hours, the specimens are prepared metallographically, i.e. an examination can later be carried out on the cross-sectional powder polished section. The preparation comprises the steps: grinding at from 150 to 240 N using bonded SiC paper having the particles sizes 800, 1000 and 1200; polishing with diamond suspensions having a particle size of 3 μm; final polishing using an OPS (oxide polishing suspension) having a particle size of 0.04 μm; cleaning of the specimens in an ultrasonic bath and drying of the specimens. Ten pictures of different, representative particles are subsequently produced for each specimen. This is achieved by means of scanning electron microscopy using a four-quadrant ring detector for detection of back-scattered electrons. The excitation voltage is 20 kV, and the tilting angle is 0°. The images are sharply focused. The resolution should be at least 1024×768 pixels for correct image analysis. The contrast is selected so that the pores are clearly distinguished from the metal matrix. The enlargement for the pictures is selected so that each image contains one particle. The quantitative image analysis is carried out using the Software Image Access. The "particle analysis" module is utilized. Each image analysis follows the steps: setting of a grayscale threshold so that open pore volume in the particles is recognized; definition of a measuring frame (maximum-size to circle/rectangle within a particle–area 0.02–0.5 $mm^2$); detection setting: measurement only in the ROI, inclusion of the image margin, cutting-off of the ROI by object. Filter functions are used neither in taking the picture nor in the analysis of the images. Since the pores in a back-scattered electron image appear significantly darker than the metallic matrix, the "dark objects" are defined as pores in the detection setting. After the ten images have been individually analyzed, a statistical evaluation of the data is carried out. The average proportion by area of the pores (%), which can be equated with the average porosity in percent by volume, is determined therefrom.

The porosity here is preferably at least partly open porosity. To a person skilled in the art, the term open porosity refers to voids which are connected to one another and to the surroundings. The proportion by volume of open pores, based on the total porosity, is advantageously >30%, very advantageously >50%, preferably >70% and particularly preferably >90% by volume.

A particularly advantageous embodiment of the invention is a coating material containing particles which are at least partly present as aggregates and/or agglomerates and at least partly have an average porosity determined by means of quantitative image analysis of >10% by volume.

The powder form (aggregate and/or agglomerates) and the porosity of the particles makes it possible to produce dense and firmly-adhering layers or bodies made up of layers. How the powder form and the porosity affect the layer quality is not yet understood in detail. However, it is assumed that an interplay of a plurality of mechanism plays a role here. Powder form (aggregate and/or agglomerates) and analogously porosity bring about the following property changes:

- reduction of the yield stress,
- promotion of microplastic flow processes,
- low hardening as a result of cold forming (short displacement paths to the nearest surface),
- improved particle spreading on impact,
- improved mechanical intermeshing,
- lower mass at a comparable particle size and thus great acceleration/velocity of the particles on/after injection into the gas stream, and/or
- lower heat loss compared to powders having a comparable BET surface area.

In the case of brittle materials, the particle size of the coating material has to date been kept very small and/or He has been used as process gas because only in this way could the velocity necessary for adhesion be achieved. However, very fine powders display poor powder flow and can lead to a blockage in the powder conveying systems. In addition, the use of fine powder leads to a deterioration in the layer quality since the particle bonding on impact on the substrate is poorer in the case of powders having a very small particle size than in the case of coarser powder. The size effects are based on dynamic effects like the very fast equalization of the heat evolved locally at the interfaces on impingement and also a higher dynamic strength of the material as a result of strain hardening. Both are more pronounced for impingement of small particles. The process of the invention now makes it possible to achieve a layer or a body of high quality even when using an inexpensive process gas and when using powders having satisfactorily good flow behavior.

The layers according to the invention can thus be deposited not only using the process gas helium, which as mentioned above leads to a higher particle velocity, but advantageously also using nitrogen as process gas, with the nitrogen content advantageously being >50% by volume, preferably >90% by volume. Nitrogen without any admixture of other gases is particularly preferably used as process gas. The use of nitrogen-containing gas or nitrogen as process gas allows economical implementation of the invention.

The process gas is preferably passed through at least one heater which according to the invention has, at least in regions, a temperature of >800° C. before the convergent-divergent nozzle. For the purposes of the present invention, only the heater temperature but not the gas temperature will be referred to, since the former can be measured precisely. Furthermore, it is advantageous for the heater to have a temperature of >900° C., in particular >1050° C. This leads firstly to layers having even better properties, in particular mechanical properties, and also allows the heater to be arranged at a somewhat greater distance from the spray gun. Particularly advantageous further ranges are >1100° C., >1200° C., >1300° C. or >1400° C. Furthermore, the heater temperature is advantageously <1700° C. since disadvantageous adhesion effects of the individual particles between one another and/or with components of the cold gas spraying play, e.g. the convergent-divergent nozzle, occur at higher temperatures.

Furthermore, it is advantageous for the particles to have an average nanohardness $H_{IT}$ 0.005/30/1/30 of <10 GPa. To determine the nanohardness, a powder polished section is prepared and the nanohardness is determined on the polished cross-sectional area of the particles. The nanohardness $H_{IT}$ 0.005/30/1/30 is determined in accordance with EN ISO 14577-1 (2002 edition) using a Berkovich penetration body and the evaluation method of Oliver and Pharr. The hardness value relates to a powder or powder granules which has/have preferably been subjected to no additional after-treatment such as a heat treatment. The nanohardness in the case of Mo is preferably <4.5 GPa or <3.5 GPa. In the case of very demanding requirements, a nanohardness $H_{IT}$ 0.005/30/1/30 of <3 GPa is advantageous in the case of Mo. In the case of tungsten, the following particularly advantageous values can be indicated: nanohardness $H_{IT}$ 0.005/30/1/30 of <9 GPa or <8 GPa.

Furthermore, it is advantageous for the particles to have a particle size $d_{50}$ of >5 μm and <100 μm. The $d_{50}$ value is measured by means of laser light scattering in accordance with the standard (ISO 13320-2009). Further advantageous ranges are 5 μm<$d_{50}$<80 μm or 10 μm<$d_{50}$<50 μm. Values in the lower size range can be achieved without or with an additional granulation step. Values in the upper $d_{50}$ range are preferably achieved by means of a granulation step. The coating material is thus advantageously present as granules.

Furthermore, it is advantageous for the coating material to have a bimodal or multimodal particle size distribution. A bimodal distribution is a frequency distribution having two maxima. A multimodal distribution has at least three maxima. Both in the case of the bimodal frequency distribution and in the case of the multimodal frequency distribution, the value of the maximum in the region of coarser particles is preferably less than at least one value of a further frequency maximum at a smaller particle size. Here too, the effect is not understood in detail. A possible explanation lies in the greater mass of the coarse particles. The coarse particles improve the adhesion of the previously deposited fine particles without it being important whether the coarse particles are or are not incorporated in the layer.

A similar effect presumably occurs when the coating material contains spherical particles having a high density (low porosity) which likewise represents a preferred embodiment of the invention. The average porosity determined by means of quantitative image analysis is in this case preferably <10% by volume, in particular <5% by volume or 1% by volume. It has been found to be most advantageous for the particles to be dense (porosity=0), as results from conventional production processes for spherical powders (for example melting in a plasma jet). The proportion of spherical particles having an average porosity of <10% by volume in the coating material is preferably from 0.1 to 40% by mass, particularly preferably from 0.1 to 30%, from 0.1 to 20% by mass or from 0.1 to 10% by mass.

A similar advantageous densification effect can be achieved when the coating material contains hard material particles, which represents a further preferred embodiment of the invention. For the present purposes, the term hard material refers, in particular, to carbides, nitrides, oxides, silicides and borides. Particularly advantageous effects are achieved when using carbides, nitrides, oxides, silicides and/or borides based on molybdenum and/or tungsten. The proportion of hard material particles in the coating material is in this case preferably from 0.01 to 40% by mass, particularly preferably from 0.1 to 30% by mass, from 0.1 to 20% by mass or from 0.1 to 10% by mass.

A high specific BET surface areas of the particles, advantageously of >0.05 $m^2/g$, also contributes to a high quality of the layer or of the body. The BET measurement is carried out in accordance with the standard (ISO 9277:1995, measurement range: 0.01-300 $m^2/g$; instrument: Gemini II 2370, baking temperature: 130° C., baking time: 2 hours; adsorptive: nitrogen, volumetric evaluation by means of five-point determination). Further preferred embodiments are: BET surface area s>0.06 $m^2/g$, >0.07 $m^2/g$, >0.08 $m^2/g$, >0.09 $m^2/g$ or >0.1 $m^2/g$.

The thickness of the deposited layer is preferably >10 μm. The thickness is particularly advantageously >50 μm, >100 μm, >150 μm or >300 μm. The layer can be made up of a single layer or preferably of a plurality of sublayers.

As mentioned above, it is also possible to produce a preferably self-supporting body by arrangement of many layers on top of one another. Here, the layers can be deposited on a lost mold. For the purposes of the present invention, a lost mold is a substrate which is detached again after deposition of the layer or possibly after a subsequent heat treatment in order to relieve stresses in the layer. The detachment can be carried out by means of a thermal process, with detachment being achieved by exploiting the different coefficients of expansion. However, removal of the lost mold can also be carried out by means of a chemical or mechanical process. In this way, it is possible to produce, for example, shaped bodies having a tubular, pot, nozzle or plate shape.

Thermal energy can advantageously be introduced into the coating material before and/or during impingement on the substrate body or on the previously produced layer. The thermal energy is preferably introduced by means of electromagnetic and/or induction. For example, a laser beam can be directed at the impingement point of the particles, which enables both the layer structure and the layer adhesion to be favorably influenced.

The coating material according to the invention can be produced in a simple manner, for example by granulation of an oxidic compound and reduction of this compound, as is described in more detail in the example.

The object of the invention is also achieved by a layer or a body built up in layers which contains at least 80 at. % of at least one element selected from the group consisting of Mo and W. Particularly advantageous contents are >90 at. %, >95 at. % or 99 at. %. In the case of a layer, this has an average layer thickness of >10 μm. The average layer thickness is preferably >50 μm or >100 μm, particularly preferably >150 μm and >300 μm. The layer or the body comprises, at least in regions, cold-deformed Mo- or W-containing grains which are extended in a direction parallel to the surface of the layer or of the body and have an average aspect ratio of >1.3.

The process of the invention here implies that the particles are deformed on impingement on the substrate, at least partly at a temperature below the melting point of the particles. Adiabatic shear bands can represent regions where temperatures above the respective melting point can occur to a limited extent. As part of the layer or of the body, the deformed particles are referred to as grains. The grains are, according to the invention, at least partially cold-deformed. For the purposes of the present invention, cold deformation has the metallurgical definition, namely that the particles are deformed on impingement on the substrate under conditions (temperature/time) which do not lead to any recrystallization. Since the time for which thermal energy acts in the process of the invention is very short, the temperature required for recrystallization is high in accordance with the Arrhenius relationship. A cold-deformed microstructure is characterized by a characteristic displacement structure as is well known to any expert or is described in detail in textbooks. The displacement structure can be made visible, for example, by means of a TEM examination.

The cold-deformed grains of the layer/of the body are at least partly extended in a direction parallel to the layer/body surface (in the lateral direction), with the average (average of at least ten extended grains) having an aspect ratio (grain aspect ratio=GAR; corresponds to length divided by width of the grains) being >1.3. The average aspect ratio is particular preferably >2, >3, >4, >5 or >10. The aspect ratio is determined metallographically by image analysis.

As a result of the at least partial cold deformation, the deformed grains advantageously have at least partly an average nanohardness $H_{IT}$ 0.005/30/1/30 of >4.5 GPa. The average nanohardness $H_{IT}$ 0.005/30/1/30 is particularly preferably >5 GPa or >6 GPa. In the case of W-based materials, values of >7 GPa or >8 GPa can also be achieved. Measurement of the nanohardness is carried out on a polished section in a manner analogous to that described above for the determination of the powder hardness. A small proportion of the particles does not experience any deformation, or experiences only a small degree of deformation, during the spraying operation. This results in a proportion of grains which are not deformed or deformed to only a small degree of preferably <20%, in particular <10% and <5%.

A body consisting of many layers, in particular a self-supporting body, is particularly preferably present. The preferred volume is >1 $cm^3$, particularly preferably >5 $cm^3$, >25 $cm^3$, >50 $cm^3$, >100 $cm^3$ or >500 $cm^3$.

Furthermore, the layer/the body preferably has a density (measured by the buoyancy method) of >90%, in particular >95%, >98% or >99%. The oxygen content of the layer is preferably <0.3% by mass, particularly preferably <0.1% by mass, and the carbon content is <0.1% by mass, particularly preferably <0.005% by mass.

BRIEF DESCRIPTION OF THE SEVERAL VIEWS OF THE DRAWING

The invention will be described below by means of examples.

DESCRIPTION OF THE INVENTION

EXAMPLE 1

Figure 1:
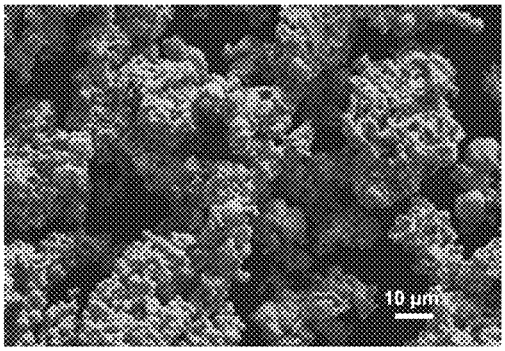
FIG. 1 and FIG. 2 show scanning electron micrographs of Mo particles according to the invention in a sieve fraction of −45/+20 μm.
Figure 2:
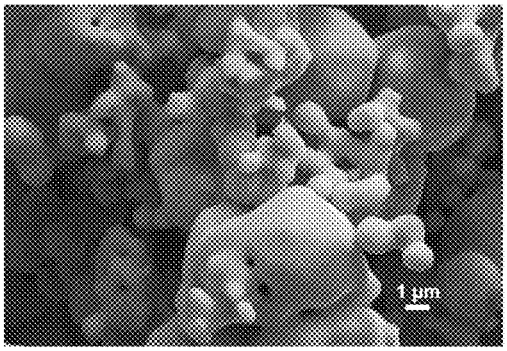
Figure 3:
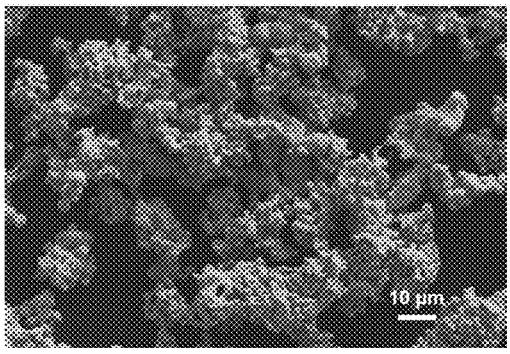
FIG. 3 and FIG. 4 show scanning electron micrographs of Mo particles according to the invention in a sieve fraction of −20 μm.
Figure 4:
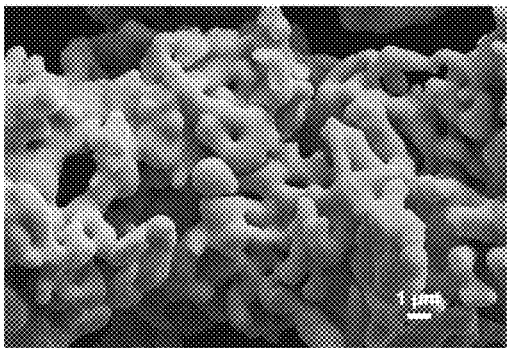

$MoO_2$ powder having a particle size measured by the Fisher method (FSSS) of 3 μm was introduced into a stirred tank and mixed with such an amount of water that a slurry having a viscosity of about 3000 mPa·s was formed. This slurry was sprayed in a spray granulation plant to give granules. These granules were reduced under hydrogen in a reduction step at 1100° C. to give Mo metal powder. The Mo powder produced in this way was sieved at 45 μm and 20 μm (sieve fractions of −45/+20 μm) and −20 μm. The sieve fraction of −45/+20 μm is shown in FIGS. 1 and 2, and the sieve fraction of −20 μm is shown in FIGS. 3 and 4. FIGS. 1 and 4 show that the particles have the typical appearance of aggregates or agglomerates. An attempt was now made to deagglomerate the powder by action of ultrasound (20 Hz, 600 W). However, since this was possible only to a small extent, most of the powder is, according to the definition given in the description, present as aggregate. The determination of the porosity was carried out by quantitative image analysis as described in detail in the description. Here, the porosity of ten particles was determined, with the average porosity value for the sieve fraction of −45/+20 μm being about 40% by volume and that for the sieve fraction of −20 μm being about 35% by volume. The BET surface area was determined in accordance with ISO 9277:1995 (instrument: Gemini 2317/model 2, degassing at 130° C./2 h under reduced pressure, adsorptive: nitrogen, volumetric evaluation by five-point determination) and for the sieve fraction of −45/+20 μm was 0.16 $m^2/g$ and for the sieve fraction of −20 μm was 0.19 $m^2/g$. The particle sizes were determined by laser light scattering (in accordance with ISO13320 (2009)). The $d_{50}$ values are shown in table 1. A powder polished section was then prepared and the average (average of ten measurements) nanohardness $H_{IT}$ 0.005/30/1/30 (measured in accordance with EN ISO 14577-1, 2002 version, Berkovich penetration body and evaluation method of Oliver and Pharr) was determined on the cross section. The average nanohardnesses are likewise summarized in Table 1.

EXAMPLE 2

Mo-1.2% by mass HfC metal powder having an FSSS (particle size determined by means of Fisher Subsieve Sizer) of 2 μm was processed by spray granulation to give granules, with the individual granules having a virtually ideal spherical shape. Polyvinylamine dissolved in water was used as binder for this purpose. The binder was removed thermally at 1100° C. in a hydrogen atmosphere. The heat treatment in hydrogen also led to sinter bridge formation by surface diffusion, but without densification by grain boundary diffusion occurring. The spherical shape was not altered by the heat treatment. The determination of the porosity was carried out by quantitative image analysis as described in detail in the description. Here, the porosity of ten granules was determined, with the average porosity value being about 57% by volume. The particle sizes were determined by laser light scattering (in accordance with ISO13320 (2009)). The $d_{50}$ is reported in Table 1.

EXAMPLE 3

Mo-30% by mass W metal powder (not prealloyed) having an FSSS (particle size determined by means of Fisher Subsieve Sizer) of 2.5 μm was processed to give granules and characterized in a manner analogous to Example 2. The binder was removed at 1100° C. The average porosity was about 59% by volume. The $d_{50}$ is reported in Table 1.

EXAMPLE 4

Figure 5:
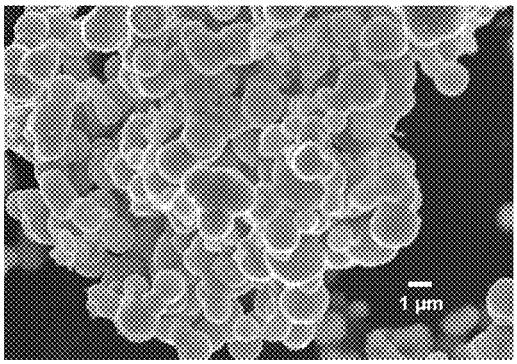
FIG. 5 shows a scanning electron micrograph of W particles according to the invention in a sieve fraction of −45/+20 μm.

W blue oxide ($WO_{3-x}$) having a particle size determined by the Fisher method (FSSS) of 7 μm was reduced under hydrogen at 850° C. in a single-stage reduction process. The W powder produced in this way was sieved at −45/+20 μm. FIG. 5 shows that the particles have the typical appearance of aggregates or agglomerates. An attempt was made to deagglomerate the powder by action of ultrasound (20 Hz, 600 W). However, since this was possible to only a small extent, most of the powder is, according to the definition given in the description, present as aggregate. The determination of the porosity was carried out by quantitative image analysis as described in detail in the description. Here, the porosity of ten particles was determined, with the average porosity being about 45% by volume. The BET surface area was determined in accordance with ISO 9277:1995 (instrument: Gemini 2317/model 2, degassing at 130° C./2 h under reduced pressure, adsorptive: nitrogen, volumetric evaluation by five-point determination) and was 0.14 $m^2/g$. The particle sizes were determined by laser light scattering (in accordance with ISO13320 (2009)). The $d_{50}$ is reported in Table 1. A powder polished section was subsequently prepared and the average (average of ten measurements) nanohardness $H_{IT}$ 0.005/30/1/30 (measured in accordance with EN ISO 14577-1, 2002 version, Berkovich penetration body and evaluation process of Oliver and Pharr) was determined on the cross section. This is likewise reported in Table 1.

TABLE 1

| | Mo powder Sieve fraction −45/+20 μm (as per Example 1) | Mo powder Sieve fraction −20 μm (as per Example 1) | Mo-1.2% by mass HfC/Mo-30% by mass W powder (as per Examples 2, 3) | W powder Sieve fraction −45/+20 μm (as per Example 4) |
|---|---|---|---|---|
| $d_{50}$ particle size (μm) | 13 | 11 | 26/22 | 14 |
| Nanohardness $H_{IT}$ 0.005/30/1/30 (GPa) | 3.0 | 3.2 | — | 6.1 |

EXAMPLE 5

Mo powder having the sieve fractions of −45/+20 μm and −20 μm as per Example 1, Mo-1.2% by mass HfC granules as per Example 2, Mo-30% by mass W granules as per Example 3 and W powder of the sieve fraction −20 μm as per Example 4 were sprayed by cold gas spraying (CGS). A ground tube made of the steel 1.4521 (X 2 CrMoTi 18-2) was used as substrate, with the diameter being 30 mm and the length being 165 mm. The tubes were cleaned by means of alcohol before coating, clamped in a rotatable holder and coated at the free end. A circumferential layer was produced on the rotating substrate. The cold gas spraying process was carried out using nitrogen (86 $m^3$/h). The process gas pressure was 49 bar. The process gas was heated in a heater which had a temperature of 1100° C. and was arranged in the spray gun. The process gas/powder mixture was conveyed through a Laval nozzle and sprayed perpendicularly to the substrate surface at a spraying distance of 40 mm. The axial advance of the spray gun was 0.75 mm/s and the speed of rotation of the substrate was 650 rpm. The powder was supplied by means of a perforator disk from a powder container which was under a pressure of 50 bar.

In further experiments, the temperature of the heater was reduced to 700° C. and 800° C. or increased to 1200° C.

Figure 6:
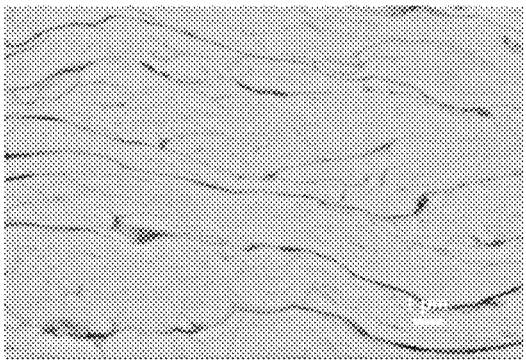
FIG. 6 shows a scanning electron micrograph of a CGS Mo layer according to the invention.

Layers could be deposited at all temperatures using all powders. However, at 700° C., isolated layer defects such as detachment between individual grains were observed, so that these layers are suitable only for relatively undemanding conditions. At 800, 1100 and 1200° C., dense layers which adhered well and had average layer thicknesses of >10 μm and the typical appearance (see, for example, FIG. 6 for Mo −45 μm/+20 μm/heater temperature 1100° C.) of CGS layers could be produced. The deposited layers had cold-deformed Mo or W grains. The average grain aspect ratio GAR (grain length divided by grain width) was determined by means of quantitative metallography and was in the range from 2 to >5. The average nanohardness $H_{IT}$ 0.005/30/1/30 was about 5 GPa in the case of Mo (powder as per Example 1) and about 9 GPa in the case of W (powder as per Example 4). At the heater temperature of 1200° C., it was possible to produce not only layers having a thickness of 150 μm and above but also shaped bodies having a volume of about 500 $cm^3$ using all powders.

Figure 7:
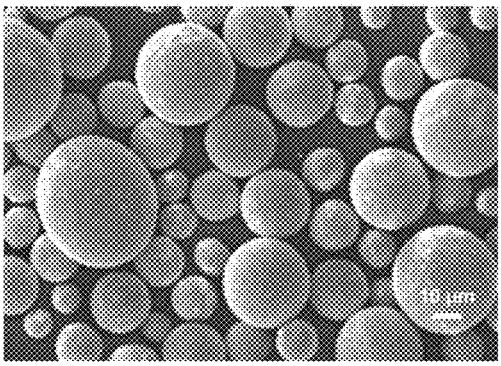
FIG. 7 shows a scanning electron micrograph of a spherical W powder used for comparative purposes.

For comparison, a noninventive spherical, dense W powder (see FIG. 7) having a $d_{50}$ particle size of 28 pm was also sprayed at 1100° C. No buildup of a layer occurred here.

The invention claimed is:

1. A process for producing a layer or a body built up of layers, the process comprising:

providing a coating material formed of particles selected from the group consisting of Mo, W, an Mo-based alloy, a W-based alloy, and an Mo—W alloy, wherein greater than 50% of all of the particles are present as aggregates and/or agglomerates;

providing the aggregates and/or agglomerates with an average surface area, which is measured by BET, of greater than 0.05 $m^2$/g, and wherein the aggregates and/or agglomerates have an average porosity, which is determined by quantitative image analysis, of greater than 10% by volume;

providing a process gas at a pressure of greater than 10 bar;

accelerating the process gas in a convergent-divergent nozzle and injecting the coating material into the process gas before, in or after the convergent-divergent nozzle; and depositing the coating material to form the layer or the body built up of layers.

2. A process for producing a layer or a body built up of layers, the process comprising: providing a coating material formed of particles selected from the group consisting of Mo, Wo, an Mo-based alloy, a W-based alloy, and an Mo-W alloy, wherein the particles are at least partly present as aggregates and/or agglomerates and wherein the particles at least partly have an average porosity, determined by quantitative image analysis, of >10% by volume; providing a process gas at a pressure of greater than 10 bar; accelerating the process gas in a convergent-divergent nozzle and injecting the coating material into the process gas before, in or after the convergent-divergent nozzle; and depositing the coating material to form the layer or the body built up of layers.

3. The process according to claim 1, which comprises providing the aggregates and/or agglomerates with an average nanohardness HIT 0.005/30/1/30 of ≤10 GPa.

4. The process according to claim 1, which comprises providing the coating material at least partly in granulate form.

5. The process according to claim 1, which comprises providing the coating material with spherical particles having an average porosity, which is determined by quantitative image analysis, of <10% by volume.

6. The process according to claim 1, wherein the coating material comprises hard material particles.

7. The process according to claim 1, wherein the coating material has a bimodal or multimodal particle size distribution.

8. The process according to claim 1, which comprises passing the process gas through a heater.

9. The process according to claim 7, wherein the heater has, at least in regions, a temperature of >800° C.

10. The process according to claim 1, which comprises providing the process gas with a nitrogen content of >50% by volume.

11. The process according to claim 1, which comprises providing the coating material with >80 at. % of at least one element selected from the group consisting of Mo and W.

12. The process according to claim 1, which comprises introducing thermal energy into the coating material before and/or during impingement on a substrate body or a previously produced layer.

13. The process according to claim 12, wherein the introducing step comprises injecting the thermal energy by way of electromagnetic waves and/or by way of induction.

14. The process according to claim 1, which comprises depositing the coating material on a substrate body to form an adhering layer having an average layer thickness of >10 μm on impingement on the substrate body.

15. The process according to claim 1, which comprises producing a body made up of a multiplicity of layers.

* * * * *